US008100195B2

(12) United States Patent
Tao et al.

(10) Patent No.: US 8,100,195 B2
(45) Date of Patent: Jan. 24, 2012

(54) MOTOR COOLING RADIATORS FOR USE IN DOWNHOLE ENVIRONMENTS

(75) Inventors: Chen Tao, Sugar Land, TX (US); Thomas Meyer, Manvel, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 324 days.

(21) Appl. No.: 12/476,765

(22) Filed: Jun. 2, 2009

(65) Prior Publication Data

US 2010/0300751 A1 Dec. 2, 2010

(51) Int. Cl.
*E21B 36/00* (2006.01)
*F28D 7/02* (2006.01)
*F28D 7/04* (2006.01)

(52) U.S. Cl. ..... 175/17; 165/156; 165/163

(58) Field of Classification Search ..... 175/17; 165/156, 163

See application file for complete search history.

(56) References Cited

U.S. PATENT DOCUMENTS

| | | | | |
|---|---|---|---|---|
| 4,231,425 | A * | 11/1980 | Engstrom | 165/156 |
| 4,895,203 | A * | 1/1990 | McLaren | 165/41 |
| 5,487,423 | A * | 1/1996 | Romero | 165/156 |
| 6,736,198 | B2 * | 5/2004 | Zhu et al. | 165/156 |
| 7,661,460 | B1 * | 2/2010 | Cowans et al. | 165/64 |
| 2008/0314638 | A1 | 12/2008 | Kaul et al. | |

* cited by examiner

*Primary Examiner* — Giovanna Wright

(57) ABSTRACT

Example motor cooling radiators for use in downhole environments are disclosed. A disclosed example radiator comprises a cylindrical housing having an annular passageway. The housing defines an inlet at a first end of the housing and an outlet at a second opposite end of the housing. A channel is arranged within the annular passageway of the housing along a spiral path to transport the first liquid and to define a spiral flow passageway between the inlet and the outlet for the second liquid. In operation, the first liquid does not contact the second liquid and heat is transferred between the first and second liquids as the second liquid flows in the spiral passageway.

20 Claims, 2 Drawing Sheets

MOTOR COOLING RADIATORS FOR USE IN DOWNHOLE ENVIRONMENTS

BACKGROUND

Reservoir well production and testing involves drilling subsurface formations and/or monitoring various subsurface formation parameters. Drilling and monitoring typically involves using downhole tools having electrically powered, mechanically powered, and/or hydraulically powered devices. To power downhole tools using hydraulic power, a motor and a pump may be used to pump and/or pressurize hydraulic fluid. Such pump systems may be configured to draw hydraulic fluid from a hydraulic fluid reservoir and pump the hydraulic fluid to create a particular pressure and flow rate to provide necessary hydraulic power. The motor and/or pump can be controlled to vary output pressures and/or flow rates to meet the needs of particular applications and/or tools. During operation, the motor of a hydraulic pump system can generate significant amounts of heat, which can build up in a downhole tool and be detrimental to the operation of the downhole tool.

BRIEF DESCRIPTION OF THE DRAWINGS

The present disclosure is best understood from the following detailed description when read with the accompanying figures. It is emphasized that, in accordance with standard practice in the industry, various features are not drawn to scale. In fact, the dimensions of the various features may be arbitrarily increased or reduced for clarity of discussion. Moreover, while certain embodiments are disclosed herein, other embodiments may be utilized and structural changes may be made without departing from the scope of the invention.

DETAILED DESCRIPTION

Figure 2:
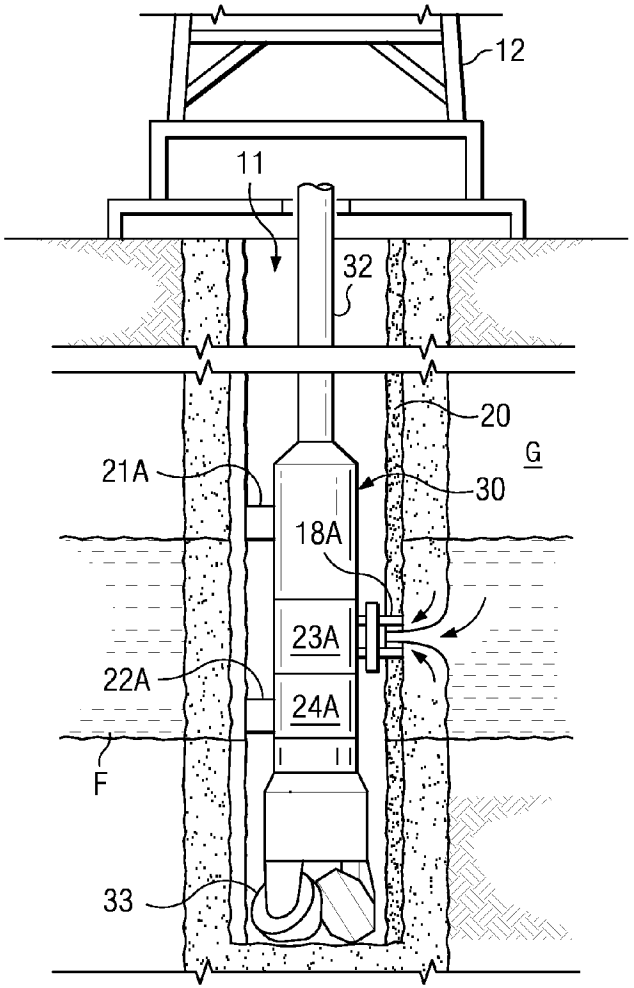
FIG. 2 depicts an example drillstring downhole assembly that may be used to evaluate geologic formations and includes a hydraulic pump module according to one or more aspects of the present disclosure.

Downhole formation sampling tools can be used in situ to collect geologic formation fluid samples, and/or to test or characterize a geologic formation. Such tools measure formation pressures and/or collect formation fluid samples under high-temperature and/or high-pressure conditions (e.g., 400° F. and/or 30,000 pounds per square inch (psi)). Such downhole tools can require large amounts of energy to operate and, thus, may internally generate large amounts of heat. If not properly managed, the internal heating can result in the overheating of motors, pumps and/or electronics within the downhole tool leading to, for example, improper operation of the downhole tool and/or premature component failure (s). In some cases, electronics are effectively cooled by using heat sinks and/or forced cooling via a cooling sleeve. Additionally or alternatively, a hydraulic motor and pump unit located in a hydraulic pump module can also be cooled via a cooling sleeve. For example, the motor can be positioned in thermal contact with an inner sleeve of the hydraulic pump module, and an external pump may be used to force a cooling fluid (e.g., a drilling mud) between the inner sleeve and an outer sleeve. The flow of the cooling fluid cools the inner sleeve and, thus, transfers heat from the motor to the cooling fluid. The effectiveness of the cooling sleeve at cooling the motor depends on the thermal conductivity between the motor and the inner sleeve, which may, in turn, depend on machining tolerances of the motor and/or the inner sleeve.

Under some circumstances, the temperature of the hydraulic fluid and/or oil pumped by the hydraulic motor and pump increases over time due to repeated circulation of the hydraulic fluid through the hydraulic pump module containing the warm motor. Thus, the ability of the hydraulic fluid to assist in the transfer of heat away from the motor can decrease over time.

To overcome these difficulties, the example downhole tools described herein include hydraulic pump modules having a motor cooling radiator according to one or more aspects of the present disclosure to transfer heat from the hydraulic fluid and/or oil to a cooling fluid (e.g., a drilling fluid or mud) and, thus, cool the motor. As will be described in detail below, as the hydraulic fluid returns to and/or flows back toward the hydraulic pump module, the hydraulic fluid flows through coiled tubing positioned within the cooling sleeve (i.e., through a cooling radiator). As the hydraulic fluid flows through the coiled tubing and the drilling fluid flows through the cooling sleeve alongside the coiled tubing, heat is transferred from the hydraulic fluid to the drilling fluid (i.e., via a liquid-to-liquid heat transfer). The cooled hydraulic fluid enters the hydraulic pump module and, having had its temperature reduced, is better able to transfer heat from the motor to the hydraulic fluid, thereby reducing the temperature of the motor. Because the cooling radiator (i.e., the coiled tubing positioned with the cooling sleeve) cools the motor, it will be referred to herein as a "motor cooling radiator."

While the example motor cooling radiators disclosed herein are described with reference to example downhole tools, it should be apparent to those of ordinary skill in the art that the example motor cooling radiators described herein can be used in any number and/or type(s) of additional and/or alternative applications where heat transfer between any two fluids is desired.

Figure 1:
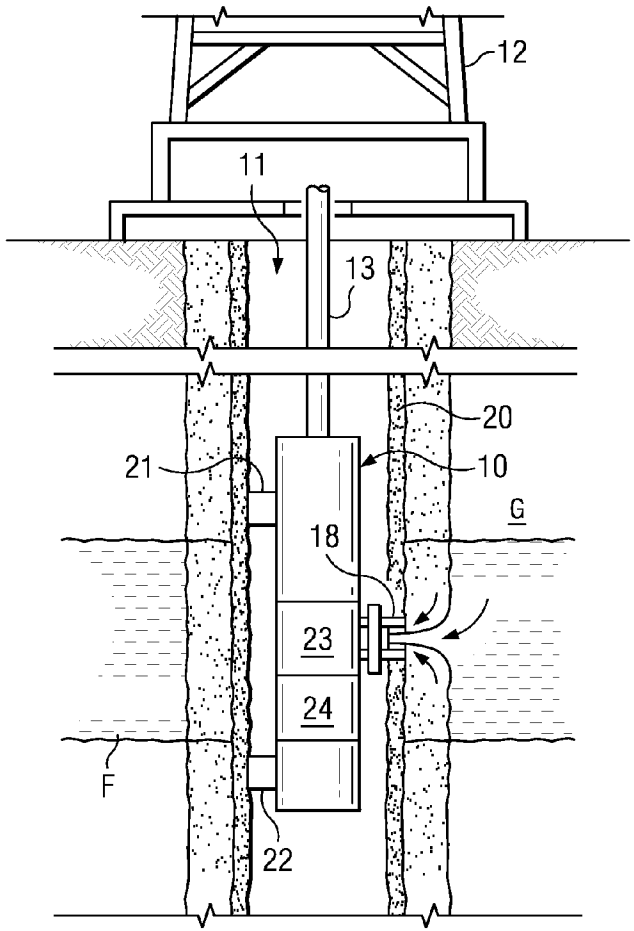
FIG. 1 depicts an example wireline downhole assembly that may be used to evaluate geologic formations and includes a hydraulic pump module according to one or more aspects of the present disclosure.

FIG. 1 shows a schematic, partial cross-sectional view of an example wireline downhole tool 10 that can be employed onshore and/or offshore. The example downhole tool 10 of FIG. 1 is suspended in a wellbore 11 formed in a geological formation G by a rig 12. The example downhole tool 10 can implement any type of downhole tool capable of performing formation evaluation, such as x-ray fluorescence, fluid analysis, fluid sampling, well logging, formation stress testing, etc. The example wireline downhole tool 10 of FIG. 1 is deployed from the rig 12 into the wellbore 11 via a wireline cable 13, and positioned adjacent to a particular geological formation F. The wellbore 11 may be formed in the geologic formation G by rotary and/or directional drilling.

To seal the example downhole tool 10 of FIG. 1 to a wall 20 of the wellbore 11 (hereinafter referred to as a "wall 20" or "wellbore wall 20"), the example downhole tool 10 may include a probe 18. The example probe 18 of FIG. 1 forms a seal against the wall 20 and may be used to draw fluid(s) from the formation F into the downhole tool 10 as depicted by the arrows. Backup pistons 21 and 22 assist in pushing the example probe 18 of the downhole tool 10 against the wellbore wall 20.

To take measurements of and/or perform tests on the formation F and/or fluids drawn from the formation F via the probe 18, the example wireline downhole tool 10 of FIG. 1 includes any number and/or type(s) of measurement modules, sondes and/or tools, one of which is designated at reference numeral 23. In some examples, the sonde 23 of FIG. 1 is fluidly coupled to the probe 18 and/or another port of the wireline downhole tool 10 via a flowline (not shown).

To hydraulically power the example sonde 23 and/or any number and/or type(s) of additional and/or alternative modules and/or portions of the downhole tool 10, the example downhole tool 10 of FIG. 1 includes a hydraulic pump module 24. As described below in connection with FIGS. 3, 4 and 5, the example hydraulic pump module 24 of FIG. 1 includes a motor cooling radiator to cool a motor M of the hydraulic pump module 24 by cooling a hydraulic fluid and/or oil pumped and/or pressurized by the hydraulic pump module 24.

FIG. 2 shows a schematic, partial cross-sectional view of another example of a drillstring downhole tool 30. The example downhole tool 30 of FIG. 2 can be conveyed among one or more of (or itself may be) a measurement-while-drilling (MWD) tool, a LWD tool, or any other type of drillstring downhole tools that are known to those skilled in the art. The example drillstring downhole tool 30 is attached to a drillstring 32 and a drill bit 33 driven by the rig 12 and/or a mud motor (not shown) driven by mud flow to form the wellbore 11 in the geological formation G. The wellbore 11 may be formed in the geologic formation G by rotary and/or directional drilling To seal the example drillstring downhole tool 30 of FIG. 2 to the wall 20 of the wellbore 11, the downhole tool 30 may include a probe 18A. The example probe 18A of FIG. 2 forms a seal against the wall 20 and may be used to draw fluid(s) from the formation F into the downhole tool 30 as depicted by the arrows. Backup pistons 21A and 22A assist in pushing the example probe 18A of the downhole tool 30 against the wellbore wall 20. Drilling is stopped before the probe 18A is brought in contact with the wall 20.

To take measurements of and/or perform tests on the formation F and/or fluids drawn from the formation F via the probe 18A, the example drillstring downhole tool 30 of FIG. 2 includes any number and/or type(s) of measurement modules, sondes and/or tools, one of which is designated at reference numeral 23A. In some examples, the sonde 23A of FIG. 2 is fluidly coupled to the probe 18A and/or another port of the drillstring downhole tool 30 via a flowline (not shown).

To hydraulically power the example sonde 23A and/or any number and/or type(s) of additional and/or alternative modules and/or portions of the drillstring downhole tool 30, the example drillstring downhole tool 30 of FIG. 2 includes a hydraulic pump module 24A. As described below in connection with FIGS. 3, 4 and 5, the example hydraulic pump module 24A of FIG. 2 includes a motor cooling radiator to cool a motor M of the hydraulic pump module 24A by cooling a hydraulic fluid and/or oil pumped and/or pressurized by the hydraulic pump module 24A.

While not shown in FIGS. 1 or 2, the example downhole tools 10 and 30 may include any number and/or type(s) of additional and/or alternative modules such as, but not limited to, a top hat (TNAT™) module, an electronics module (TNPX™), a PumpOut module (TNPO™), a modular dynamics tester (MDT) adapter (TNAM™), a multisample probe (TNMS™), a probe (TNPQ™), a telemetry cartridge (EDTC™) and/or a logging head (LEH™), all of which are manufactured by Schlumberger. An example wireline downhole tool that can be used to implement the example wireline downhole tool 10 of FIG. 1 is the TALN™ wireline sampling tool manufactured by Schlumberger.

Figure 3:
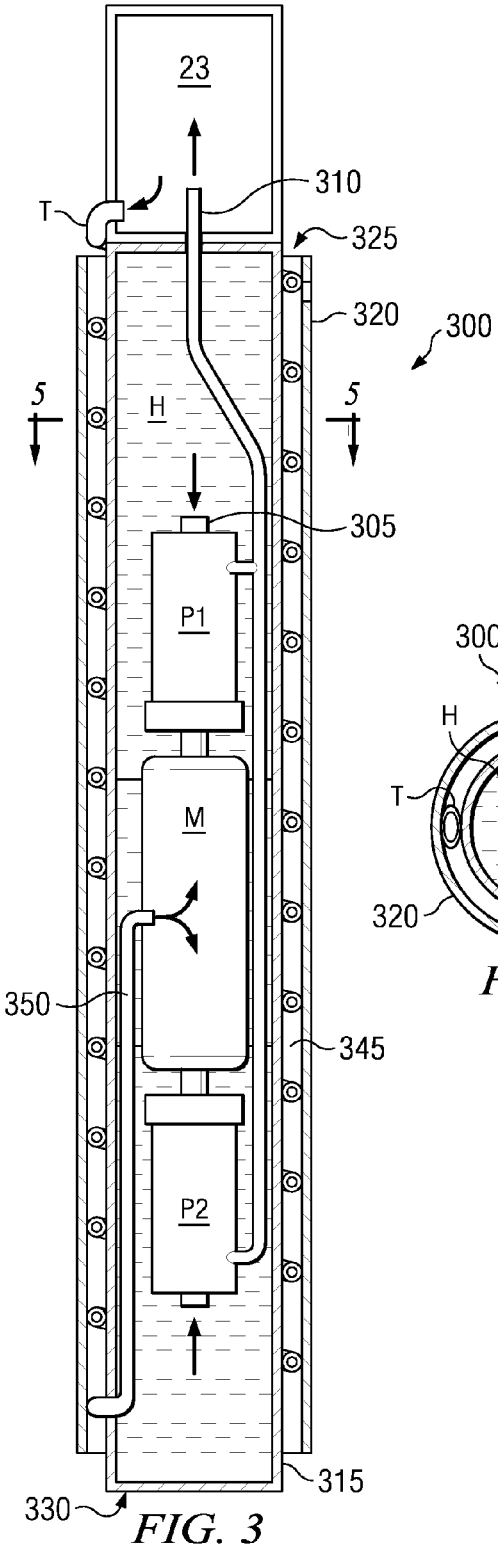
FIG. 3 is a side cross-sectional view of an example hydraulic pump module having a motor cooling radiator according to one or more aspects of the present disclosure.
Figure 5:
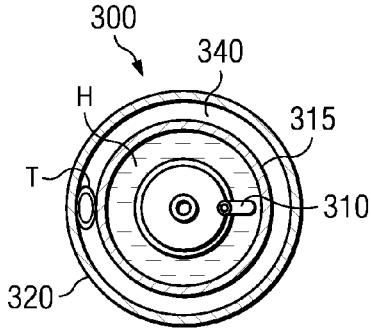
FIG. 5 is a top cross-sectional view of an example hydraulic pump module having a motor cooling radiator according to one or more aspects of the present disclosure.
Figure 4:
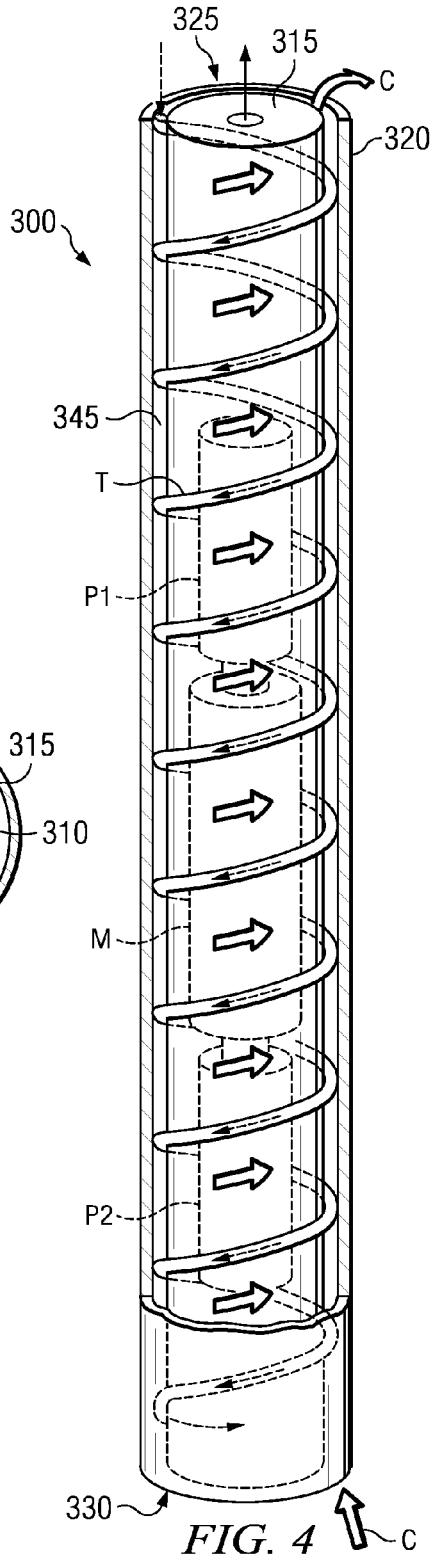
FIG. 4 is a partial cut-away view of an example hydraulic pump module having a motor cooling radiator according to one or more aspects of the present disclosure.

FIGS. 3, 4 and 5 depict an example hydraulic pump module 300 that may be used to implement the example hydraulic pump modules 24 and 24A and/or, more generally, to implement the example downhole tools 10 and 30 of FIGS. 1 and 2. While any of the hydraulic pump modules 24 and 24A and/or any of the tools 10 and 30 may be implemented by the example device of FIGS. 3-5, for ease of discussion, the example device of FIGS. 3-5 will be referred to as the hydraulic pump module 300. FIG. 3 illustrates a side cross-sectional view of the example hydraulic pump module 300. FIG. 4 illustrates a partial cut-away view of the example hydraulic pump module 300. FIG. 5 illustrates a top cross-sectional view of the example hydraulic pump module 300 taken along line 5-5 of FIG. 3.

In general, the example hydraulic pump module 300 of FIGS. 3-5 operates to create a hydraulic fluid flow having a desired pressure and/or flow rate suitable to hydraulically power, for example, the example sonde 23 of FIG. 1. When the example hydraulic pump module 300 is part of a drillstring, the hydraulic pump module 300 includes a passage (not shown) to permit drilling fluid to be pumped through the hydraulic pump module 300 to remove cuttings away from a drill bit.

To pump and/or pressurize a hydraulic fluid H, the example hydraulic pump module 300 of FIGS. 3-5 includes an electric motor M and one or more pumps, two of which are designated with reference numerals P1 and P2. The example motor M of FIGS. 3-5 is selectively operable to operate the example pumps P1 and P2. When operating, the example pumps P1 and P2 of FIGS. 3-5 draw in the hydraulic fluid H via respective inlets, one of which is designated at reference numeral 305, and pump the hydraulic fluid H toward the example sonde 23 via a pipe, channel and/or tubing 310. In the illustrated example of FIGS. 3-5, the motor M and the pumps P1 and P2 are immersed in the hydraulic fluid H within a cylindrical inner housing 315 of the hydraulic pump module 300. Thus, the example cylindrical inner housing 315 of FIGS. 3-5 forms a reservoir of the hydraulic fluid H. While not shown in FIGS. 3-5 for clarity of illustration, it should be understood that there may be any number and/or type(s) of support(s) and/or member(s) that position and/or secure the motor M and the pumps P1 and P2 within the inner housing 315.

The hydraulic fluid H is returned from the example sonde 23 to the example hydraulic pump module 300 via a channel and/or tubing T positioned between the cylindrical inner housing 315 and a cylindrical outer housing 320 of the hydraulic pump module 300. In the illustrated example of FIGS. 3-5, the tubing T comprises coiled tubing spirally positioned between a top end 325 of the hydraulic pump module 300 and a bottom end 330 of the hydraulic pump module 300. As shown in FIG. 5, the coiled tubing T is spirally arranged in an annular and/or ring-shaped passageway or region 340 defined by the cylindrical inner and outer housings 315 and 320.

As best seen in FIGS. 3 and 5, a diameter and/or dimension of the example channel and/or tubing T may be substantially equal to a distance and/or separation between the cylindrical inner housing 315 and the cylindrical outer housing 320. In the case where the diameter of the tubing T is substantially equal to the separation between the housings 315 and 320, the tubing T forms a spiral fluid passageway 345 for a cooling fluid C (e.g., a drilling fluid or mud). The example tubing T of FIGS. 3-5 directs the cooling fluid C along the spiral path 345 along the outside of the tubing T (e.g., a flow path that follows the tubing T), as depicted by the arrows in FIG. 4. By directing the cooling fluid C alongside the tubing T, an amount of time that the cooling fluid C is in thermal contact with the tubing T and, thus, the returning hydraulic fluid H is increased. Moreover, because the tubing T has a diameter substantially equal to the separation between the housings 315 and 320, the cooling fluid C is restricted from bypassing portions of the tubing T and, thus, is directed to follow the spiral fluid passageway 345. In the example of FIGS. 3-5, the returning hydraulic fluid H flows downward through the spiraled coiled tubing T, and the cooling fluid C flows upward in the spiral fluid passageway 345 formed and/or defined by the spiraled coiled tubing T. As shown in the example of FIG. 4, the returning hydraulic fluid H flows in a clockwise direction and the cooling fluid C flows in a counter-clockwise direction, when viewed from the top 325 of the hydraulic pump module 300. The cooling fluid C enters a cooling sleeve formed by the cylindrical inner and outer housings 315 and 320 via an inlet and/or opening at the bottom 330 of the hydraulic pump module 300, flows through the spiral passageway 340, and exits the cooling sleeve via an outlet and/or opening at the top 325 of the hydraulic pump module 300. As the cooling fluid C flows through the spiral passageway 340, the cooling fluid C is warmed by (i.e., absorbs heat from) the returning hydraulic fluid H, thereby cooling (i.e., removing heat from) the returning hydraulic fluid H.

While in the illustrated example of FIGS. 3-5 the returning hydraulic fluid H and the cooling fluid C flow in opposite directions to increase heat transfer effectiveness and/or efficiency, the hydraulic fluid H and the cooling fluid C can be directed so as to flow in the same direction.

At the bottom of the example hydraulic pump module 300 of FIGS. 3-5, the returning hydraulic fluid H exits the coiled tubing T having been cooled by the cooling fluid C, and is directed via a pipe, channel and/or tubing 350 proximate the example motor M. Thus, the cooled hydraulic fluid H flows into the hydraulic fluid reservoir near to the warm motor M. As the hydraulic fluid H subsequently flows outward toward the inlets 305 of the pumps P1 and P2, the hydraulic fluid H transfers heat away from the motor M. Accordingly, the cooling sleeve defined by the cylindrical inner housing 315 and the cylindrical outer housing 320, the tubing T, and the flow passageway 345 defined by the tubing T form a cooling radiator for the motor M.

The dimensions of the coiled tubing T can be selected based on desired heat transfer and pressure loss characteristics. In general, as the diameter of the tubing T decreases or the length of the tubing T increases (e.g., the coiled tubing T is wrapped more times around the inner housing 315), heat transfer from the returning hydraulic fluid H to the cooling flood increases, and the returning hydraulic fluid H experiences a greater pressure loss. Thus, the dimensions of the coiled tubing T can be selected to tradeoff hydraulic fluid pressure loss and motor cooling efficiency. While coiled tubing T is depicted in the illustrated example of FIGS. 3-5, other types of devices to form a fluid passageway T for the returning hydraulic fluid H may be used. For example, a fluid passageway T having a rectangular cross-section may be used.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents. Further, while the examples described here are described in connection with implementations involving downhole environments, the example radiator apparatus described herein may also be advantageously applied in other environments.

In view of the foregoing description and figures, it should be clear that the present disclosure describes motor cooling methods and apparatus for use in downhole environments that may be used to, in some examples, to cool a motor of a hydraulic pump module in a downhole tool. In particular, the present disclosure introduces a motor cooling radiator to transfer heat between first and second liquids, where the radiator includes a cylindrical housing having an annular passageway. The housing may define an inlet at a first end of the housing and an outlet at a second opposite end of the housing. A channel is arranged within the annular passageway of the housing along a spiral path to transport the first liquid and to define a spiral flow passageway between the inlet and the outlet for the second liquid. Additionally, the first liquid does not contact the second liquid and heat is transferred between the first and second liquids as the second liquid flows in the spiral passageway. The radiator may further include a second housing such as a sonde, a pump positioned in the cylindrical housing to pump the first liquid to a hydraulically-powered device in the second housing, where the first liquid flows through the channel while returning from the second housing to the cylindrical housing, and a motor positioned in the cylindrical housing to operate the pump, where the first liquid is to transfer heat from the motor to the second liquid via the channel and the spiral flow passageway.

The present disclosure also introduces a downhole tool that includes a hydraulically-activated downhole tool module. The downhole tool module comprises a hydraulic module including an outer cylindrical housing having a first diameter, and an inner cylindrical housing positioned within the outer cylindrical housing. The inner cylindrical housing has a second diameter smaller than the first diameter, a region between the inner and outer cylindrical housings defining a cylindrical annular region having an inlet at a first end and an outlet at a second end. Additionally, the coiled tubing may be arranged between the first and second ends within the cylindrical annular region to define a spiral flow passageway between the inlet and the outlet for a drilling fluid, and to return the hydraulic fluid from the hydraulically-activated downhole tool module to the inner cylindrical housing. A pump may be positioned in the inner cylindrical housing to pump the hydraulic fluid to the hydraulically-activated downhole tool module, and a motor may be positioned in the inner cylindrical housing to operate the pump, where the hydraulic fluid is to transfer heat from the motor to the drilling fluid via the tubing and the spiral flow passageway.

What is claimed is:

1. A radiator to transfer heat between first and second liquids, comprising:

a cylindrical housing having an annular passageway, the cylindrical housing defining an inlet at a first end of the cylindrical housing and an outlet at a second opposite end of the cylindrical housing;

a channel arranged within the annular passageway of the cylindrical housing along a spiral path to transport the first liquid and to define a spiral flow passageway between the inlet and the outlet for the second liquid, wherein the first liquid does not contact the second liquid and heat is to be transferred between the first and second liquids as the second liquid flows in the spiral passageway;

a second housing;

a pump positioned in the cylindrical housing to pump the first liquid to a device in the second housing, wherein the first liquid flows through the channel while returning from the second housing to the cylindrical housing; and a motor positioned in the cylindrical housing to operate the pump, wherein the first liquid is to transfer heat from the motor to the second liquid via the channel and the spiral flow passageway.

2. A radiator as defined in claim 1, wherein the first liquid is to flow in a direction from the second end of the cylindrical housing to the first end of the cylindrical housing, and wherein the second liquid is to flow from the inlet to the outlet.

3. A radiator as defined in claim 1, wherein the first liquid is to flow in a first rotational direction, and wherein the second liquid is to flow in a second rotational direction opposite the first rotational direction.

4. A radiator as defined in claim 1, wherein the cylindrical housing comprises:

an outer cylindrical sleeve having a first diameter; and an inner cylindrical sleeve positioned within the outer cylindrical sleeve, the inner cylindrical sleeve having a second diameter smaller than the first diameter so that a region between the inner and outer cylindrical sleeves defines the annular passageway.

5. A radiator as defined in claim 4, wherein a dimension of the channel is substantially equal to a distance between the inner and outer cylindrical sleeves.

6. A radiator as defined in claim 4, further comprising a motor positioned within the inner cylindrical sleeve, wherein the first liquid is used to transfer heat from the motor to the second liquid.

7. A radiator as defined in claim 1, wherein the motor and the pump are immersed in the first liquid within the cylindrical housing.

8. A radiator as defined in claim 1, wherein the channel comprises coiled tubing between the first and second ends of the cylindrical housing.

9. A radiator as defined in claim 1, wherein the spiral flow passageway directs the second liquid along an outside of the channel to increase a heat transfer efficiency between the first and second liquids.

10. A radiator as defined in claim 1, wherein the spiral flow passageway comprises a restricted flow path for the second liquid.

11. A downhole tool comprising:

a hydraulically-activated downhole tool module; and a hydraulic module comprising:

an outer cylindrical housing having a first diameter; and an inner cylindrical housing positioned within the outer cylindrical housing, the inner cylindrical housing having a second diameter smaller than the first diameter, a region between the inner and outer cylindrical housings defining a cylindrical annular region having an inlet at a first end and an outlet at a second end;

coiled tubing arranged between the first and second ends within the cylindrical annular region to define a spiral flow passageway between the inlet and the outlet for a drilling fluid, and to return a hydraulic fluid from the hydraulically-activated downhole tool module to the inner cylindrical housing;

a pump positioned in the inner cylindrical housing to pump the hydraulic fluid to the hydraulically-activated downhole tool module; and a motor positioned in the inner cylindrical housing to operate the pump, wherein the hydraulic fluid is to transfer heat from the motor to the drilling fluid via the tubing and the spiral flow passageway.

12. A downhole tool as defined in claim 11, further comprising a mud pump to circulate the drilling fluid through the cylindrical annular region along the spiral flow passageway.

13. A downhole tool as defined in claim 11, wherein the hydraulic fluid is to flow in a direction from the second end to the first end, and wherein the drilling fluid is to flow from the inlet to the outlet.

14. A downhole tool as defined in claim 11, wherein the hydraulic fluid is to flow in the coiled tubing in a first rotational direction, and wherein the drilling fluid is to flow in the spiral flow passageway in a second rotational direction opposite the first rotational direction.

15. A downhole tool as defined in claim 11, wherein the motor and the pump are immersed in the hydraulic fluid and wherein the hydraulic fluid is returned to the inner cylindrical housing proximate the motor.

16. A downhole tool as defined in claim 11, wherein a diameter of the coiled tubing substantially equals a separation between the inner and outer cylindrical housings.

17. A downhole tool as defined in claim 11, wherein the spiral flow passageway directs the second fluid along an outside of the coiled tubing.

18. A downhole tool as defined in claim 11, wherein the flow passageway comprises a restricted flow path for the drilling fluid.

19. An apparatus, comprising:

a downhole tool for conveyance in a wellbore extending into a subterranean formation, wherein the downhole tool comprises:

a radiator comprising a cylindrical housing and a channel, wherein:

the cylindrical housing comprises an annular passageway, an inlet, and an outlet;

the channel is arranged within the annular passageway along a spiral path to transport a first liquid and to define a spiral flow passageway between the inlet and the outlet for a second liquid;

the first liquid does not contact the second liquid; and heat is to be transferred between the first and second liquids as the second liquid flows in the spiral passageway; and a heat generating device positioned within the cylindrical housing, wherein:

heat is to be transferred between the heat generating device and one of the first and second liquids; and the heat generating device comprises at least one of a motor, a pump, and an electronic device.

20. The apparatus of claim 19 wherein the heat generating device is immersed in the first liquid within the cylindrical housing.

* * * * *